US007460800B2

(12) United States Patent
Yamauchi et al.

(10) Patent No.: US 7,460,800 B2
(45) Date of Patent: Dec. 2, 2008

(54) IMAGE FORMING APPARATUS WITH ADAPTIVE PRE-PROCESSING AND POST-PROCESSING BASED ON USAGE HISTORY

(75) Inventors: Hirokazu Yamauchi, Uji (JP); Toshiki Takiguchi, Yamatokooriyama (JP); Tatsuya Inoue, Nara (JP); Yoshiharu Yoneda, Nara (JP); Kazuhiro Matsuyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 245 days.

(21) Appl. No.: 11/369,006

(22) Filed: Mar. 7, 2006

(65) Prior Publication Data

US 2006/0210289 A1 Sep. 21, 2006

(30) Foreign Application Priority Data

Mar. 16, 2005 (JP) ..... 2005-074984

(51) Int. Cl.
*G03G 15/00* (2006.01)

(52) U.S. Cl. ..... 399/38; 399/46

(58) Field of Classification Search ..... 399/176, 399/38, 127, 46, 75; 358/504
See application file for complete search history.

(56) References Cited

U.S. PATENT DOCUMENTS

2004/0114947 A1* 6/2004 Geleynse et al. ..... 399/31

FOREIGN PATENT DOCUMENTS

| | | | |
|---|---|---|---|
| JP | 7-271174 A | | 10/1995 |
| JP | 9-258637 A | | 10/1997 |
| JP | 10-307434 A | | 11/1998 |
| JP | 2001166636 A | * | 6/2001 |
| JP | 2002-40794 A | | 2/2002 |

OTHER PUBLICATIONS computer translation of jp2002-40794A; cited by applicant.*

* cited by examiner

*Primary Examiner*—Quana M Grainger
(74) *Attorney, Agent, or Firm*—Nixon & Vanderhye P.C.

(57) ABSTRACT

An image forming apparatus includes a history storage portion for storing the usage history involving the number of prints of the image forming apparatus, and a processing time controller for changing the time of the pre-processing operation before or the time of the post-processing operation after a printing process of the printing portion, based on the stored usage history so as to exclude the influence of the unfixed developer on the printing process.

14 Claims, 10 Drawing Sheets

FIG.4

[Machine Operation History]

| | Analysis of print request content | | | | |
|---|---|---|---|---|---|
| | Request count of single printing | Request count of multiple printing | | | |
| | | 10 sheets or less | 11 to 50 sheets | 51 to 100 sheets | 101 sheets or more |
| Count | A | B | C | D | E |
| Operational status calculation coefficient | 5 | 4 | 3 | 2 | 1 |
| Effective operation factor | (5xA) | (4xB) | (3xC) | (2xD) | (1xE) |

To estimate the effective operation status of the machine, calculate $Y=\Sigma\{(5xA)+(4xB)+(3xC)+(2xD)+(1xE)\}$.

Then, determine whether the initializing operation should be extended or not based on $Y <$ (set value) or $Y \geq$ (set value). ("The set value" is determined based on whether or not the increase in volume density due to the left time of the developer in the developing hopper falls within the permissible range.)

FIG. 7

[Pre-process before printing: the present invention ]

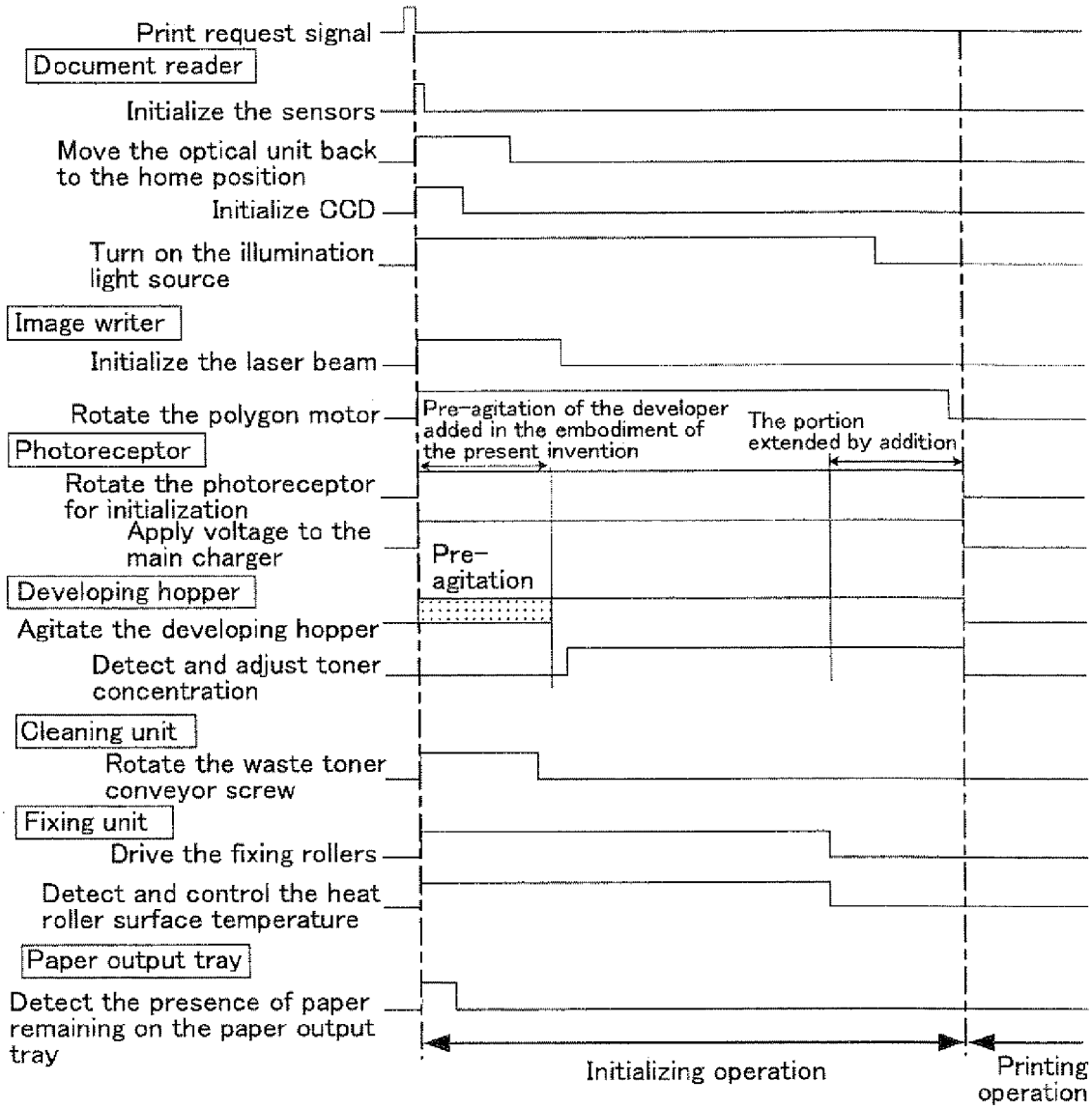

In the embodiment, based on the machine history (calculation of the unused time), either extra-time mode of adding the time of pre-agitation (in the developing hopper) or non-extra time mode can be selected.

At the extra-time mode, the initializing operation for the photoreceptor drum is also added (to prevent the drum surface from being hurt by the developing sleeve.)

At the non-extra-time mode, the same initializing operation as the conventional method is implemented.

FIG.9

[Post-process after printing]
(The present invention)

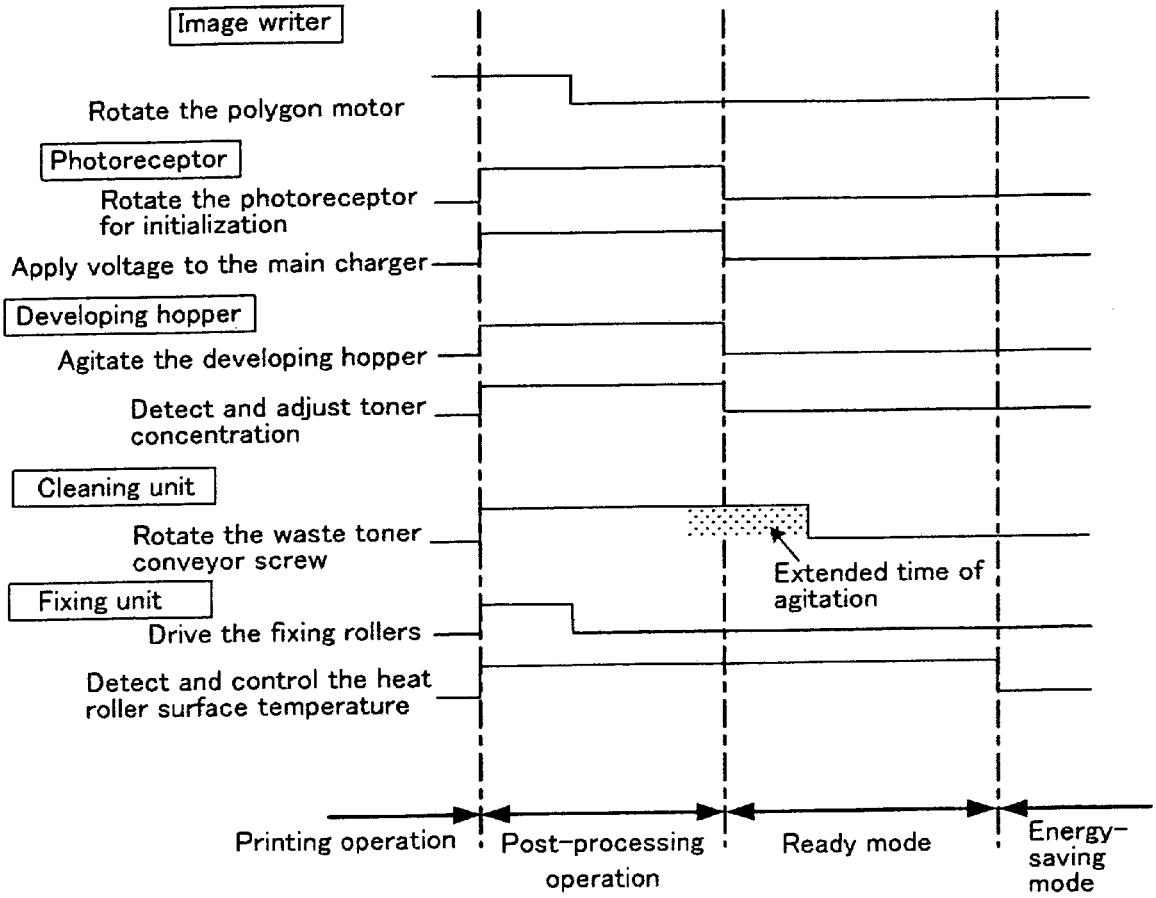

Extension of the rotation time of the waste toner conveyor screw in the post-processing operation enables the following things.

Since the waste toner laid down in the cleaning unit can be conveyed to the collecting box, the starting load of the drive source when the screw is restarted at the initializing operation of the machine can be lowered, so that it is possible to prevent locking of the drive source and breakage of the screw. If waste toner builds up in the cleaning unit, it would cause damage to the photoreceptor, inducing degradation of print quality.

IMAGE FORMING APPARATUS WITH ADAPTIVE PRE-PROCESSING AND POST-PROCESSING BASED ON USAGE HISTORY

This Non provisional application claims priority under 35 U.S.C. §119 (a) on Patent Application No. 2005-74984 filed in Japan on 16 Mar. 2005, the entire contents of which are hereby incorporated by reference.

BACKGROUND (1) Field of the Technology

The present technology relates to an image forming apparatus such as a copier, printer, facsimile machine, etc., which performs a printing process of transferring an unfixed developer image of image information to a sheet of paper that is fed and fusing and fixing the image information of the unfixed developer to the paper.

(2) Description of the Prior Art

Recently, the particle size of the toner used for image forming apparatuses has become smaller.

For example, the resolution of the image forming apparatus used to be 300 dpi (dots per inch) some years ago, but nowadays the resolution has become higher to 600 to 1200 dpi.

With this trend toward high-resolution configurations, the particle size of the toner has also become smaller. Specifically, the particle size of the toner used to be 8 to 12 μm in diameter, but is about 4 to 8 μm now. However, as the toner size becomes smaller, various kinds of problems with the image forming apparatuses also have arisen.

Examples of the problems include the lack of uniformity of toner concentration control in the developer hopper, the lock (broken drive) of the cleaning member of the photoreceptor, and the like.

However, it has been found out that all of these problems do not occur due to miniaturization of the toner particles, but occur due to printing conditions, or the usage frequency of the image forming apparatus.

For example, if there are many users who use image forming apparatuses 1000 sheets a day, some users undergo the above problem while the others do not.

The origin of whether the problem occurs or not, depending on individual users depends on the how the machine is used for 1000 sheets per day. It has been found that the machines which are used mostly for continuous prints and left out of operation during the intervening time, often suffer the above problem while the machines which are used with small amounts of prints but frequently do not suffer the above problem.

The cause of the occurrence of the above problem can be attributed to the detection characteristics of the toner concentration sensor. As declassed in Japanese Patent Application Laid-open Hei 7-271174, a typical toner concentration sensor detects toner concentration using magnetic permeability detection. In this case, as the toner concentration in the developer made up of a mixture of a toner and a magnetic carrier decreases, the magnetic permeability increases. The toner concentration sensor detects the output voltage that increases in accordance with the magnetic permeability, so that it detects a reduction in toner concentration from increase in the voltage signal.

However, with regard to the adjustment and control of the toner concentration in the developer hopper, if the toner has been left for a long time, the developer (toner and carrier) is promoted to aggregate, causing increase in volume density, due to development of the toner into small size. This increase in volume density will cause mal-detection to the toner concentration sensor of the aforementioned magnetic permeability detection type.

That is, the developer (toner and carrier) becomes dense in the developer hopper after a long cessation of the image forming apparatus, presenting an apparent high volume density. Under such condition, if the developer is agitated for a next printing operation, the toner concentration sensor will detect a lower value than the actual toner concentration at the start of agitation of the developer (toner and carrier). As a result, toner comes to be added to the developer hopper, causing "an over density of print" and toner scattering in the machine due to "excess toner", giving rise to the problem of degradation of the image to be printed on the paper.

Also in the cleaning unit for removing leftover toner from the photoreceptor drum, if the machine has not been operated for a long period, the collected toner may aggregate to cause increase in the load on the rotational drive of the conveyor screw of the collected toner at re-start, hence there is a risk of occurrence of the cleaning unit being locked. With this locking, the cleaning blade maybe excessively thrust onto the photoreceptor drum, causing damage on the photoreceptor drum and other problems, hence causing image degradation. Accordingly, it is necessary to perform a correct post-processing operation such as to convey the collected toner into the developer hopper, but there was a problem that there has been no conventional technology to perform a cleaning operation by taking into account the cessation time of the apparatus.

To sum up, the problem is that there has been no proposal of a technology to improve print quality by performing a pre-processing operation such as agitating the developer before a printing operation and performing a post-processing operation such as cleaning after a printing operation, in a suitable manner.

SUMMARY

The present technology has been devised in view of the above problems, it is therefore a feature of an example embodiment presented herein to provide an image forming apparatus in which in countermeasure against the change of the conditions of the developer with passage of time due to the usage history of the image forming apparatus, i.e., due to low frequency of usage or due to long time cessation, the developer can be processed suitably to thereby improve the quality of images to be formed on the paper.

The present technology relates to an image forming apparatus and is configured as follows.

An image forming apparatus according to an example embodiment includes: a paper feed portion for storing paper and selectively feeding and conveying the paper, sheet by sheet, from a stack of paper stored therein; a printing portion for performing a printing process for transferring image information of an unfixed developer to the fed paper; a fixing portion for fusing and fixing the image information formed of the unfixed developer to the paper; a paper discharge portion for discharging the paper with the image information fused and fixed thereon to the outside of the apparatus; a history storage portion for storing the usage history involving the number of prints of the image forming apparatus; and, a processing time controller for changing the time of the pre-processing operation before or the time of the post-processing operation after a printing process of the printing portion, based on the stored usage history so as to exclude the influence of the unfixed developer on the printing process.

In the image forming apparatus of the example embodiment, it is preferred that the usage history stored in the history storage portion is defined by separately counting the number of times the image forming apparatus has been used for printing operations for a single print and the numbers of times the apparatus has been used for printing operations for multiple prints, so as to grasp the conditions of operation of the image forming apparatus.

In the image forming apparatus of the example embodiment, it is preferred that the usage history stored in the history storage portion is the usage history of the image forming apparatus at least one day ago.

In the image forming apparatus of the example embodiment, it is preferred that the time controller calculates the printing process operation time of the image forming apparatus based on the usage history stored in the history storing portion, and extends the pre-processing operation time or post-processing operation time, longer than the usual processing operation time when the calculated printing process operation time is shorter than a predetermined reference time for change.

In the image forming apparatus of the example embodiment, it is preferred that the processing time controller calculates the printing process operation time of the image forming apparatus based on the usage history stored in the history storing portion and performs the pre-processing operation or post-processing operation with the usual processing operation time when the calculated printing process operation time is equal to or greater than a predetermined reference time for change.

In the image forming apparatus of the example embodiment, it is preferred that the predetermined reference time for change is set up based on the time over which no printing process is operated in the image forming apparatus.

In the example embodiment, it is preferred that the image forming apparatus further includes a toner concentration sensor for detecting the toner concentration of the developer made up of a toner and a carrier and held in the developer hopper, and is characterized in that, when the image forming apparatus has been unused as long as or longer than the passage of time which would affect the detection of the magnetic permeability sensor due to the time-dependent change in the volume density of the unfixed developer, the predetermined reference time for change is set in accordance with the time of cessation.

In the image forming apparatus of the example embodiment, it is preferred that the processing time controller, based on the stored usage history, extends the time of agitating the unfixed developer in the pre-processing operation until the volume density of the unfixed developer reaches a value at which the toner concentration sensor will not produce a wrong detection.

In the example embodiment, it is preferred that the image forming apparatus further includes a toner concentration sensor for detecting the toner concentration of the developer made up of a toner and a carrier and held in the developer hopper, and is characterized in that the processing time controller extends the time of agitating the unfixed developer in the pre-processing operation until at least the output value from the toner concentration sensor falls within the predetermined range.

In the image forming apparatus of the example embodiment, it is preferred that, while the time of the pre-processing operation is extended by the processing time controller, supply of the developer to the developer hopper is suspended.

In the image forming apparatus of the example embodiment, it is preferred that, after the end of the extended time of the pre-processing operation, adjustment of the developer concentration in the developer hopper is performed.

In the image forming apparatus of the present invention example embodiment presented herein, it is preferred that the printing portion has a photoreceptor drum for forming an electrostatic latent image for the unfixed developer, and the processing time controller, based on the stored usage history, extends the initializing rotational period for a developer roller at the pre-processing operation and that for the photoreceptor drum at the pre-processing operation, longer than the normal pre-processing operation time, in order to remove the influence of the unfixed developer on the printing process.

In the image forming apparatus of the example embodiment presented herein, it is preferred that the printing portion includes a photoreceptor drum for bearing image information formed with the unfixed developer and a cleaning unit that collects the unfixed developer remaining on the image support at the post-processing operation after the printing process, the influence of the unfixed developer on the printing process is time-dependent aggregation of the collected developer, and the processing time controller, based on the stored usage history, extends the drive time of the cleaning unit in the post-processing operation, longer than the normal post-processing operation time.

In the image forming apparatus of the example embodiment presented herein, it is preferred that when the cleaning unit is driven in the pre-processing operation, the cleaning unit is preferably driven with a higher torque at the initial stage of activation and then driven with a normal torque.

In the image forming apparatus of the example embodiment, it is preferred that in comparison between the printing process operation time of the image forming apparatus calculated based on the usage history stored in the history storage and a reference time for change, the processing time controller sums up the printing process operation time (T1), the pre-processing operation time (T2) and the post-processing operation time (T3) of image forming apparatus separately and makes comparison based on the following formulae, and determines whether the pre-processing operation time or post-processing operation time should be made longer or shorter than the normal processing operation time:

$$\Sigma(T1) \leqq (\Sigma(T2)+\Sigma(T3)) \quad (1)$$

$$\Sigma(T1) \leqq (\Sigma(T2)+\Sigma(T3)) \quad (2),$$

where when the relation (1) holds, the printing process operation time is determined to be equal to or longer than the predetermined reference time for change; and when the relation (2) holds, the printing process operation time is determined to be shorter than the predetermined reference time for change.

According to an example embodiment, since the image forming apparatus stores the usage history of the number of prints in the image forming apparatus and changes the time of the pre-processing operation before, or the post-processing operation after, the printing process effected by printing portion based on the stored usage history so as to exclude the influence on the printing process by the unfixed developer, it is possible to prevent the volume density of the developer from becoming high and prevent aggregation of the developer collected by the cleaning unit, for example. Accordingly, this configuration is markedly effective in eliminating the risk of the developer image being degraded and improving printing quality.

According to the example embodiment presented herein, in addition to the above effect, the following advantages can be obtained.

In the example embodiment, the usage history is a one that is defined by separately counting the number of times the image forming apparatus has been used for printing operations for a single print and the numbers of times the apparatus has been used for printing operations for multiple prints, so as to present the usage history to grasp the conditions of operation of the image forming apparatus. In this case, the pre-processing or post-processing operation time can be varied as appropriate depending on the operated status of the image forming apparatus, taking into account the operations of a single prints and the operations of multiple prints.

Also in the example embodiment presented herein, the usage history stored in the history storage portion is the usage history of the image forming apparatus at least one day ago. In this case, the usage history stored in the history storage portion may be preferably, that for one week and more preferably that for one month. When the usage history from one day ago is stored, the latest usage history can be known; and use of the usage history for one week or one month makes it possible to change the time of the pre-processing operation or post-processing operation taking into account the usage history over time.

In the example embodiment presented herein, when the calculated printing process operation time is shorter than a predetermined reference time for change, the pre-processing operation time or post-processing operation time is extended longer than the usual processing operation time. Accordingly, it is possible to effectively prevent degradation of printing quality when the condition of the developer has changed due to a lower usage time.

In the example embodiment presented herein, since when the calculated printing process operation time is equal to or greater than a predetermined reference time for change, the pre-processing operation or post-processing operation is performed with the usual processing operation time, the time for the pre-processing operation or post-processing operation is unchanged when the condition of the developer has not changed too much because the apparatus has been used in longer time or more frequently. Thus it is possible to make the whole printing operation in the apparatus more efficient without spending time for waste processing.

In the example embodiment presented herein, since the predetermined reference time for change is set up based on the time over which no printing process is operated or the image forming apparatus is unused, etc., it is possible to determine whether the pre-processing operation or post-processing operation time is changed, taking into account the status change of the developer which depends on the printing cessation time.

In the example embodiment presented herein, the influence of the unfixed developer on the printing process can be considered as a result of a rise of the volume density of the unfixed developer resulting from the cessation of the printing operation or the unused status of the image forming apparatus. Though the developer status detecting sensor such as a toner concentration sensor etc., may produce erroneous detection due to a rise of the volume density, the example embodiment can take an appropriate measure against such erroneous detection.

Further, in the example embodiment, when the toner concentration sensor detects the toner concentration of the developer held in the developer hopper, there are cases in which a wrong detection of toner concentration occurs due to change in the volume density of the developer. To deal with such situations, when the image forming apparatus has been unused as long as or longer than the passage of time which would affect the detection of the toner concentration sensor such as a magnetic permeability sensor, due to the time-dependent change in the volume density of the unfixed developer, the predetermined reference time for change is set in accordance with the time of cessation. Accordingly, it is possible to positively prevent erroneous detection of toner concentration with the toner concentration sensor.

In the example embodiment presented herein, since the processing time controller, based on the stored usage history, extends the time of agitating the unfixed developer in the pre-processing operation until the volume density of the unfixed developer reaches a value at which the toner concentration sensor will not produce a wrong detection, it is possible to exclude the influence of the volume density of the unfixed developer on printing, hence improve printing quality.

In the example embodiment presented herein, since the time of agitating the unfixed developer in the pre-processing operation is extended until at least the output value from the toner concentration sensor falls within the predetermined range, it is possible to achieve correct toner concentration adjustment based on the detected value of the toner concentration sensor after its output is stabilized.

In the example embodiment presented herein, by suspending supply of the developer to the developer hopper while the time of the pre-processing operation is extended by the processing time controller and by performing adjustment of the developer concentration in the developer hopper after the end of the extended time of the pre-processing operation, the developer can be supplied only after the volume density of the developer has been made pertinent by agitation without any risk of erroneous detection of the toner concentration sensor, so that it is possible to achieve toner concentration adjustment with high precision.

In the example embodiment presented herein, the printing portion has a photoreceptor drum for forming an electrostatic latent image for the unfixed developer. The processing time controller, based on the stored usage history, can extend the initializing rotational period for the developer roller (also called developing sleeve) and the photoreceptor drum in the pre-processing operation, longer than the normal pre-processing operation time, in order to remove the influence of the unfixed developer on the printing process. When the developing roller rotates in abutment with the photoreceptor drum while the agitator in the developer hopper is driven, there is a risk of the photoreceptor drum being damaged if only the photoreceptor drum is not operated during initialization. However, it is possible to positively prevent damage to the photoreceptor drum by also extending rotation of the photoreceptor drum during the period in which the pre-processing operation is extended.

In the example embodiment presented herein, the processing time controller, based on the stored usage history, extends the drive time of the cleaning unit in the post-processing operation, longer than the normal post-processing operation time. If the developer collected by the cleaning unit becomes aggregated with the passage of time in the storage receptacle for temporarily storing the developer, there is a fear that the conveyor such as a screw for conveying the developer from the storage receptacle, to a collection box which is separately provided or, to the developer hopper, will lock. In the post-processing operation of the example embodiment, such collected developer is removed to clean up the storage receptacle, whereby it is possible to positively prevent the conveyor from being locked and prevent the photoreceptor drum from being damaged due to breakage of the cleaning blade (degrading printing quality).

In the above, when, after the post-processing operation, the cleaning unit is driven in the pre-processing operation, the cleaning unit may be driven with a higher torque at the initial stage of activation and then driven with a normal torque. In this case, even if some collected developer remains in the collecting receptacle, the collected developer can be positively brought out by driving the cleaning unit with a high torque.

Further, in comparison between the printing process operation time of the image forming apparatus calculated based on the usage history stored in the history storage and a reference time for change, the processing time controller may sum up the printing process operation time (T1), the pre-processing operation time (T2) and the post-processing operation time (T3) of image forming apparatus separately and make comparison based on the following formulae, and determine whether the pre-processing operation time or post-processing operation time should be made longer or shorter than the normal processing operation time:

$$\Sigma(T1) \leqq (\Sigma(T2)+\Sigma(T3)) \quad (1)$$

$$\Sigma(T1) > (\Sigma(T2)+\Sigma(T3)) \quad (2)$$

where when the relation (1) holds, the printing process operation time is determined to be equal to or longer than the predetermined reference time for change; and when the relation (2) holds, the printing process operation time is determined to be shorter than the predetermined reference time for change.

Since this makes comparison using the summation of time, exact control of the processing time can be done.

BRIEF DESCRIPTION OF THE DRAWINGS

FIG. 4 is an illustrative view showing one example of an operation history of an image forming apparatus;

FIG. 7 is an illustrative timing chart of a pre-processing operation when the processing operation time is extended;

FIG. 9 is an illustrative timing chart of a post-processing operation when the processing operation time is extended.

DESCRIPTION OF THE PREFERRED EMBODIMENTS

The best mode of the embodiment of an image forming apparatus (to be referred to as "the embodiment") will be described with reference to the drawings.

Figure 1:
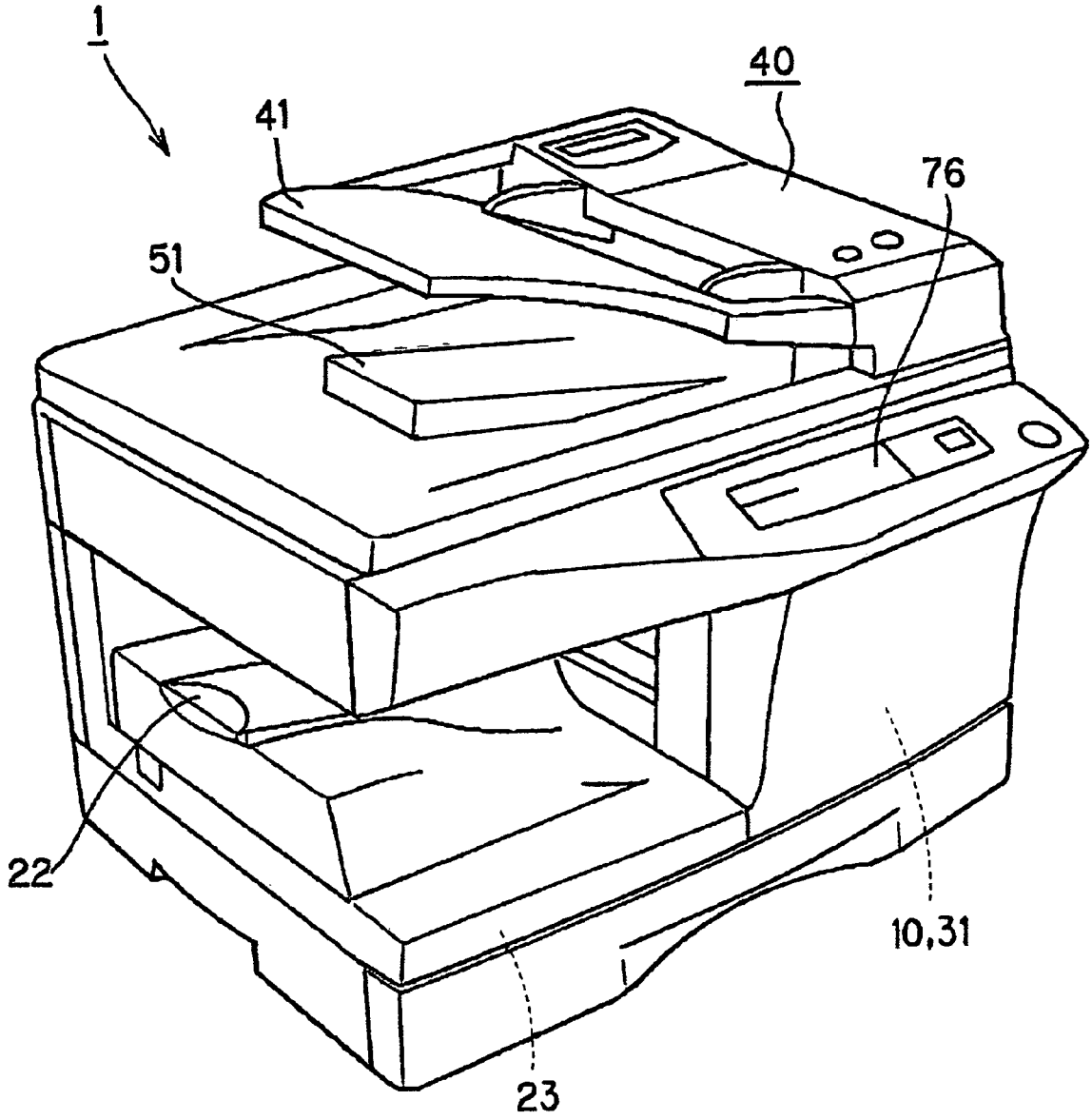
FIG. 1 is an illustrative view showing an overall external configuration of an image forming apparatus in an embodiment.

FIG. 1 shows an overall external configuration of an image forming apparatus according to an example embodiment.

Figure 2:
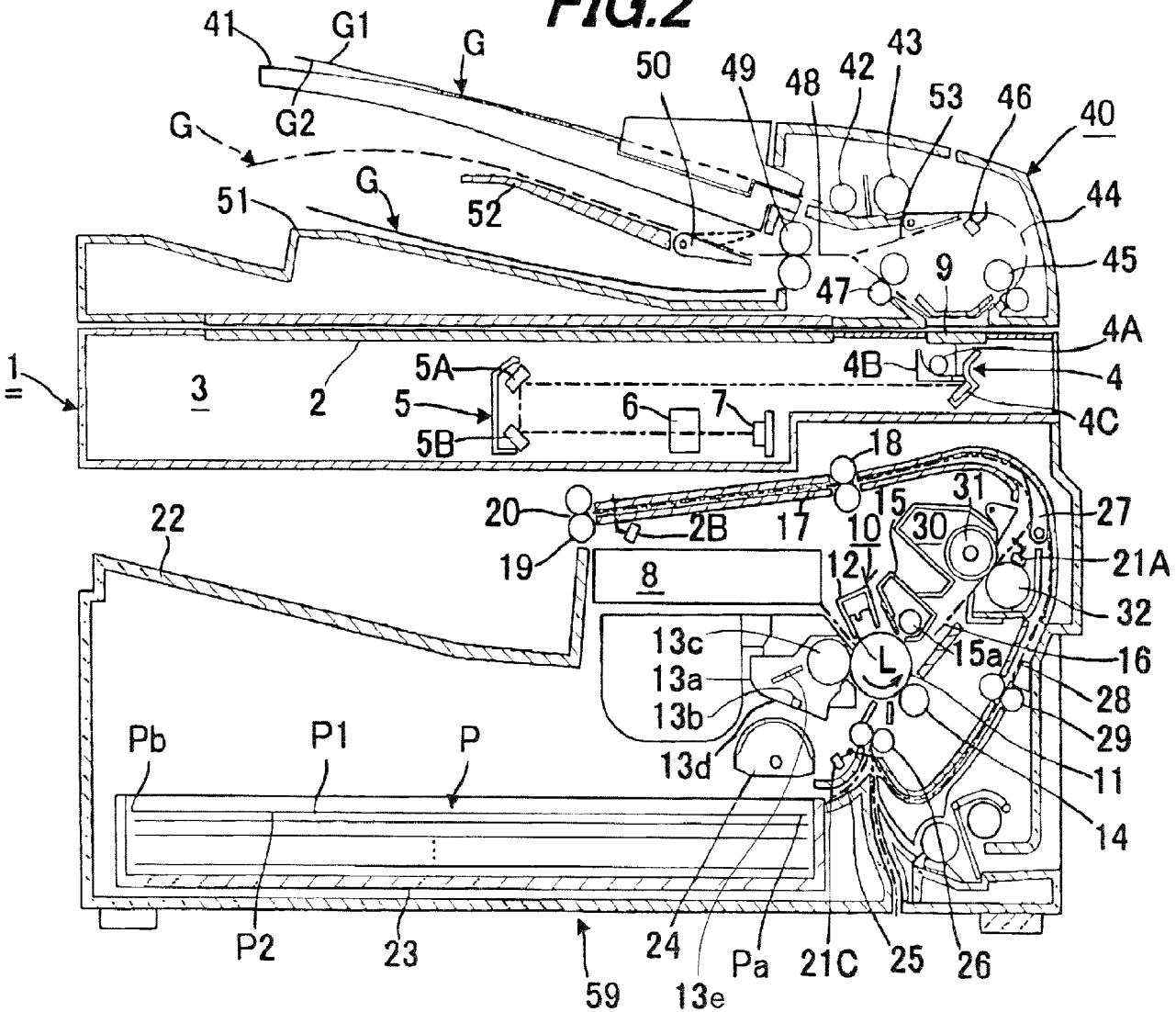
FIG. 2 is a vertical sectional illustration showing the internal structure of the image forming apparatus of FIG. 1.
Figure 3:
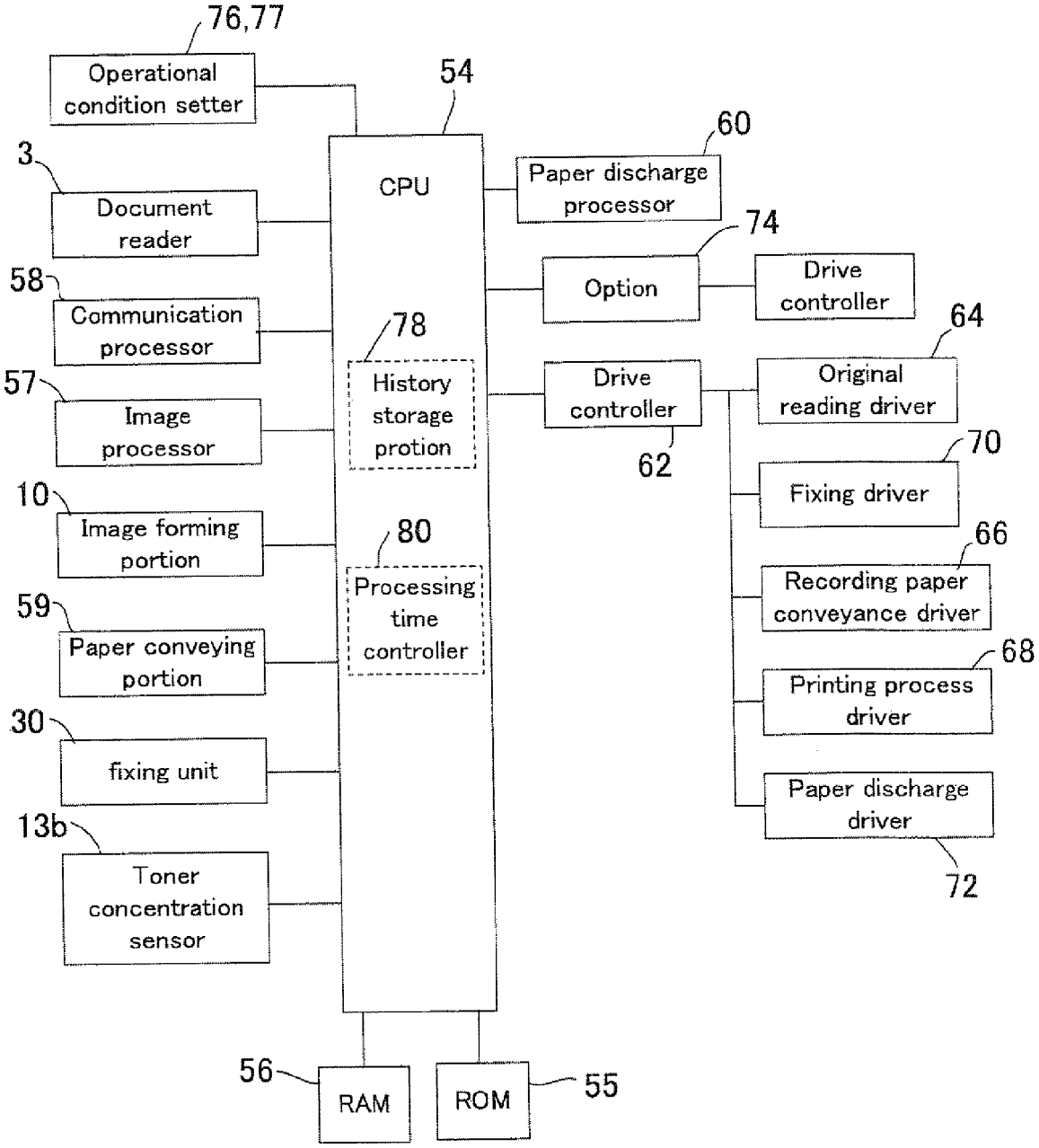
FIG. 3 is a control block diagram showing the electric control system of the image forming apparatus of FIG. 1.

FIG. 2 is a vertical sectional illustration showing the internal structure of the image forming apparatus and FIG. 3 is a control block diagram showing the electric control system of the image forming apparatus.

Figure 5:
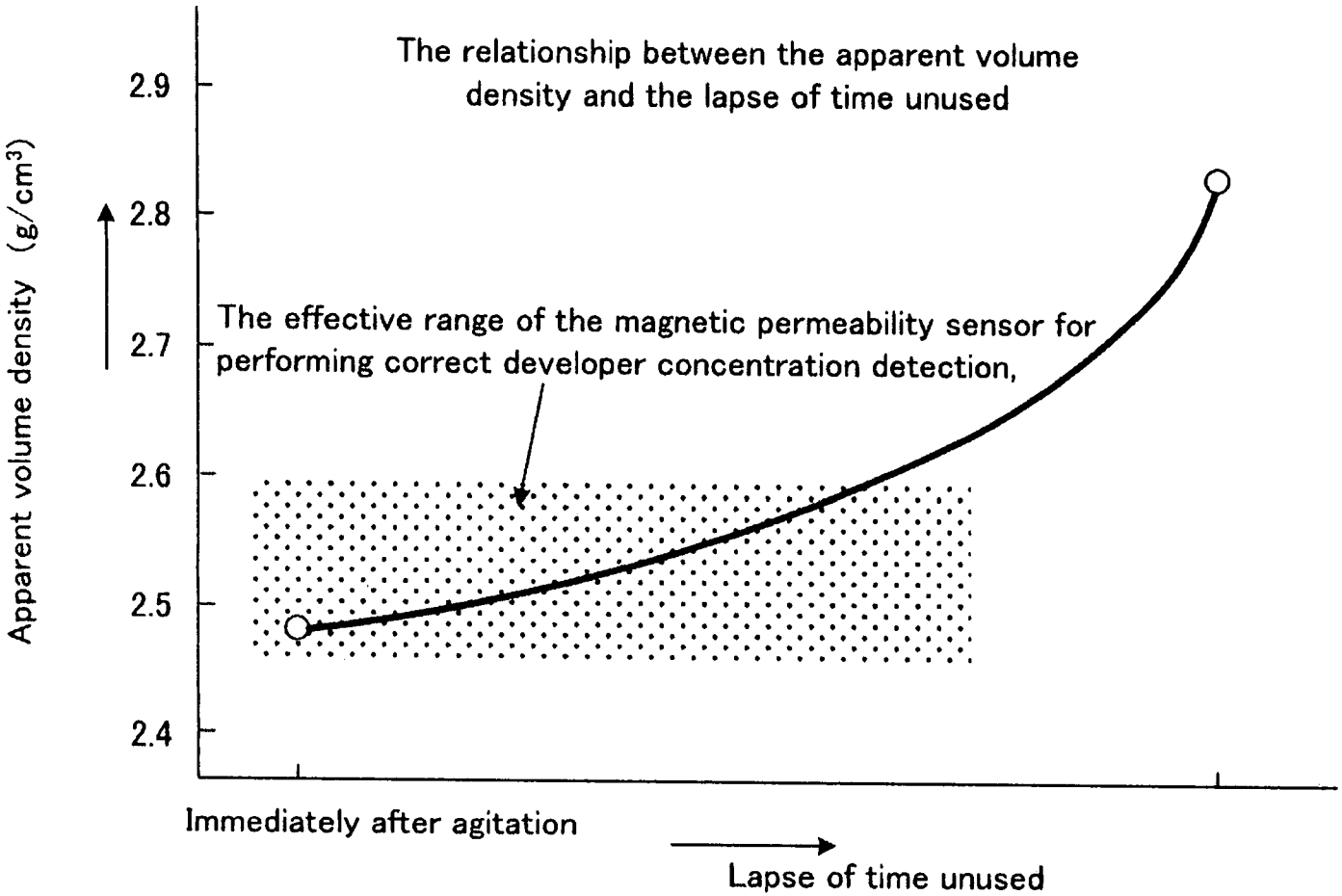
FIG. 5 is an illustrative chart showing an example of the relationship of the apparent volume density of a developer with the lapse of time unused.
Figure 10:
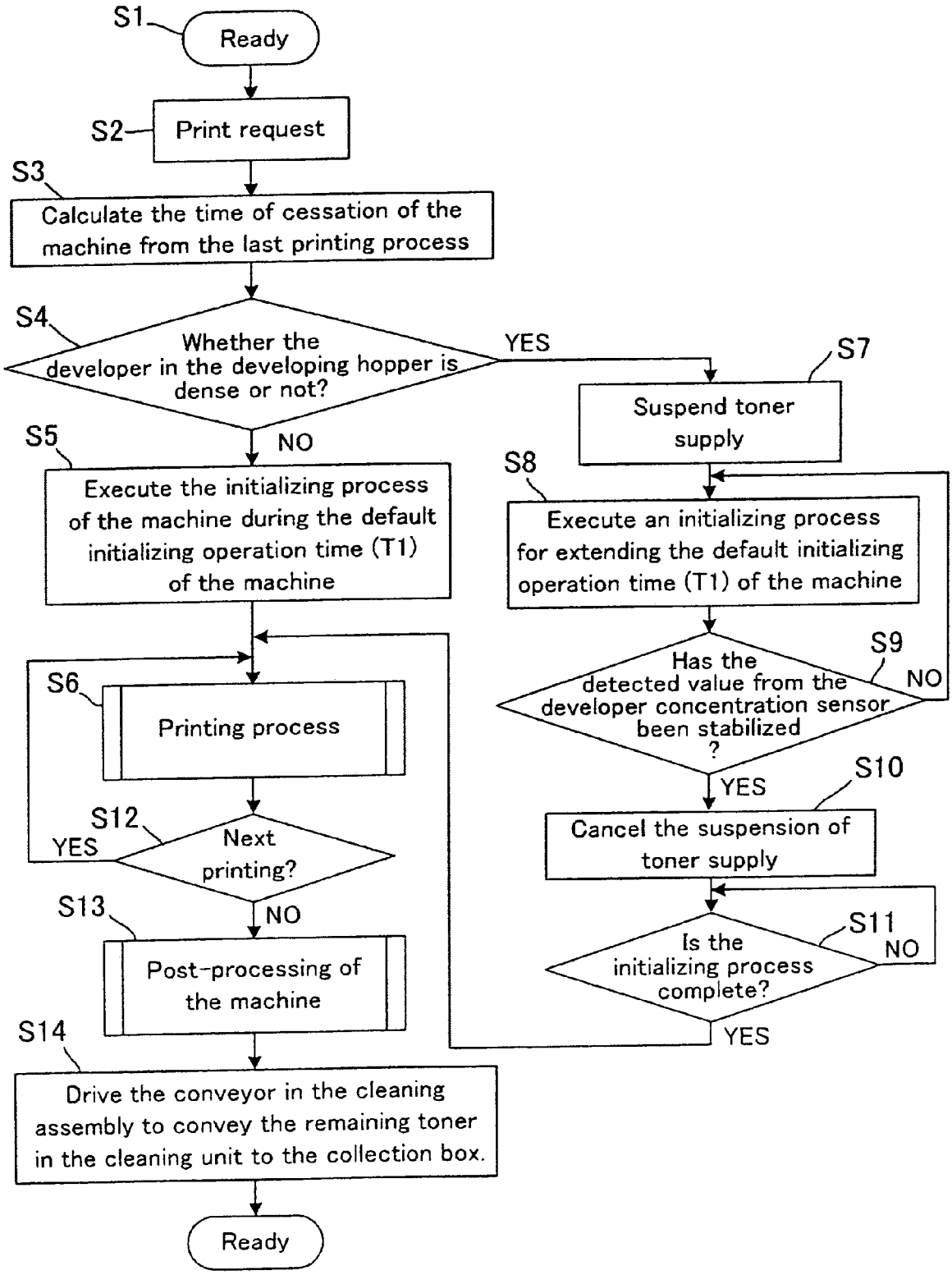
FIG. 10 is a flowchart for illustrating the control operation of an image forming apparatus of the embodiment.

FIG. 4 is an illustrative view showing one example of an operation history of an image forming apparatus; FIG. 5 is an illustrative chart showing an example of the relationship of the apparent volume density of a developer to the lapse of time unused; FIGS. 6 to 9 are time chart examples of pre-processing operations and post-processing operations when the processing operation time is not extended and when the time is extended in accordance with the present invention; and FIG. 10 is a flowchart for illustrating the control operation of an image forming apparatus in the embodiment.

In FIGS. 1 and 2, a reference numeral 1 designates a main apparatus body (machine body) of an image forming apparatus.

As shown in FIGS. 1 to 3, an original placement table 2 made of transparent glass, on which an original is placed, is provided on the top of the main apparatus body 1. A scanner portion 3 as a document reader for capturing image information of an original G is arranged under the original placement table 2.

[Scanner Portion 3]

Scanner portion 3 is composed of an original image reading unit including a first scan unit 4 and a second scan unit 5 that are arranged under original placement table 2 and reciprocate in parallel thereto, and an optical lens element 6; a photoelectric transducer (CCD) 7. In FIG. 2, the light path in scanner portion 3 is shown by the chain line.

First scan unit 4 includes an exposure lamp 4A, a reflector 4B for guiding the light from exposure lamp 4A to the original image surface and a first mirror 4C for leading the reflected light image that is obtained by exposing the original via reflector 4B and being reflected off the original, in a predetermined direction, and is controlled so as to move back and forth at a predetermined scan speed, keeping itself parallel to and a predetermined distance from, the underside of original placement table 2.

Second scan unit 5 includes a second mirror 5A and a third mirror 5B for leading the reflected light image from the original by way of first mirror 4C of first scan unit 4 in the predetermined direction and is controlled so as to move back and forth parallel to the first scan unit 4 and at a speed related to the speed of the first scan unit.

Optical lens element 6 is laid out on the light path of the reflected light from the original image, lead from third mirror 5B of second scan unit 5 so that the light image is focused on photoelectric transducer 7.

This photoelectric transducer (e.g., CCD (charge coupled device)) 7 captures the light image of the original image, focused by optical lens element 6 and photo electrically converts it into an electric signal to thereby create original image information (original image data). This original image information is output to an image processing portion 57 (FIG. 3).

[Image Processing Portion 57]

Image processing portion 57 subjects the original image information output from photoelectric transducer 7 to image processes and produces printing image information (printing image data) so that the resolution, density, etc., will be suited for printing. The printing image information obtained as a result of the image processes is sent to the image data input portion of a laser scanning unit (LSU) 8.

[Image Forming Portion (Printing Portion) 10]

Then, laser scanning unit 8 emits laser beams in accordance with the printing image information output from image processing portion 57 over the surface of photoreceptor drum 11 (also functions as an image support) as a constituent of image forming portion (printing portion for performing an image forming process) 10. In this way, an electrostatic latent image of the printing image information is written and formed on photoreceptor drum 11.

Photoreceptor drum 11 is rotationally driven in the direction of the arrow. Arranged around photoreceptor drum 11 are a main charger 12 for charging the photoreceptor drum 11 surface at a predetermined potential, laser scanning unit 8 for emitting laser beams for forming an electrostatic latent image on the photoreceptor drum 11 surface, a developing unit 13 for developing the electrostatic latent image formed by illumination of the laser beams from laser scanning unit 8 with a developer (consisting of a toner and a magnetic carrier) into a visual image (form a toner image), a transfer roller 14 for transferring the toner image of the original image that has been visualized by the developing unit 13 to a sheet of recording paper (also called "print paper") P fed through a paper feed path 25 from a paper feed cassette 23 detailed later, and a cleaning device (corresponding to a "cleaning unit") 15 for cleaning the leftover developer remaining on the photoreceptor drum 11 after the transfer with transfer roller 14, all being arranged in the rotational direction of photoreceptor drum 11 in the order mentioned.

Main charger 12 of image forming portion 10 also has the function of an unillustrated charge erasing device for erasing charge on the photoreceptor drum 11 surface after cleaning by cleaning device 15.

Developing unit 13 includes: a developer hopper 13*a* for holding the developer consisting of a toner and a carrier of magnetic material; a toner concentration sensor 13*b* of a magnetic permeability sensor for detecting the toner concentration of the developer in the developer hopper 13*a*; and a developing roller 13*c* for delivering the developer from developer hopper 13*a* to photoreceptor drum 11.

Cleaning device 15 includes: a cleaning member having a cleaning blade etc., for collecting the leftover toner from photoreceptor drum 11 by making the cleaning blade into sliding contact with the photoreceptor drum 11 and temporarily storing the collection in a storage receptacle etc.; and a waste toner conveyor screw (conveying member) 15*a* for conveying the collected waste developer (waste toner) to an unillustrated collecting box or to developer hopper 13*a*.

[Fixing Unit (Fixing Portion) 30]

The recording paper P with a toner image transferred thereon as it being nipped between photoreceptor drum 11 and transfer roller 14, is separated from the photoreceptor drum 11 surface and further conveyed along a main conveyance path 16 to fixing unit 30 where the paper enters between a heat roller (drive roller) 31 and pressing roller (an element opposing the drive roller) 32. A nip is formed at the contact between heat roller 31 and pressing roller 32 by a predetermined pressing force.

In fixing unit 30, the recording paper P held between heat roller 31 and pressing roller 32, i.e., at the nip, is heated by heat roller 31 and pressed by pressing roller 32 so that the unfixed toner image that has been transferred from photoreceptor drum 11 is fixed to the recording paper P.

Recording paper P after fixing by this fixing unit 30 is conveyed along a paper discharge path 17 toward a paper discharge roller 19 on the paper discharge port 20 side by a paper discharge drive roller 18.

[Paper Discharge Processor 60]

The recording paper P conveyed through paper discharge path 17 is detected by a fixing detection switch 21A arranged downstream of fixing unit 30 when the recording paper P passes through the nip between heat roller 31 and pressing roller 32.

For a case of usual one-sided printing, the paper is directly conveyed by the rotational drives of paper discharge drive roller 18 and a paper discharge roller 19 and discharged through paper discharge port 20 onto a paper output cassette 22 which is disposed in a space under scanner portion 3. The passage status of recording paper P through paper discharge roller 19 is adapted to be detected by a paper discharge detecting switch 21B arranged upstream of paper discharge roller 19.

Recording paper P is conveyed to the side of the image forming portion 10 and discharged to paper output cassette 22 located over paper feed cassette 23 and under scanner portion 3.

[Paper Conveying Portion 59]

Arranged at the inner bottom of main apparatus body 1 is an exchangeable paper feed cassette 23, in which a stack of recording paper P of a predetermined paper size is accommodated. A crescent-shaped sheet pickup roller 24 is arranged over the paper delivering side of this paper feed cassette 23.

This paper pickup roller 24 picks up the paper, sheet by sheet, from the topmost of a stack of recording paper P1 in paper feed cassette 23 and conveys the paper downstream (for convenience' sake, the delivery side of recording paper P (the cassette side) is referred to as upstream and the direction of conveyance is referred to as downstream) to a registration roller (also called "idle roller") 26 in paper feed path 25.

Arranged on the upstream side of registration roller 26 is a pre-registration detection switch 21C. This pre-registration detection switch 21C detects recording paper P that is fed and conveyed from paper feed cassette 23. Paper feed to the aforementioned image forming portion 10 is adapted to be performed by adjusting the paper feed timing based on this signal.

On the other hand, when duplex printing is performed, after printing by image forming portion 10 has been performed on one side of recording paper P, the recording paper P is sent into paper discharge path 17 after passage through fixing unit 30, then once conveyed to the paper discharge roller 19 side. In this condition, a paper switching gate 27 is changed over, then paper discharge roller 19 is driven in reverse so that the recording paper P is switched back and guided into sub conveyance path 28 for reversing the paper.

Then, the thus guided recording paper P is rotationally driven by a sub-drive roller 29 provided on this sub conveyance path 28 and conveyed to the upstream side of registration roller 26, so that printing on the other side of recording paper P is performed.

On original placement table 2 of main apparatus body 1 an automatic document processor 40 of a document feed type reversing automatic document feeder (R-SPF), for example, is mounted so that it can be opened and closed to also serve as an original placement cover.

As shown in FIG. 2, this automatic document processor 40 has a document tray 41 on which originals G are set. In this automatic document processor, originals G set on this document tray 41 are picked up, one by one, by a document pickup roller 42 so that original G is guided by a document drive roller 43 through a document conveyance path 44 and conveyed to the upstream side of a registration roller (PS roller) 45.

A document input sensor 46 for detecting the document size of original G is arranged on the upstream side of the registration roller 45. This document input sensor 46 detects the leading end and trailing end of original G. Conveyance of original G to a document reading station 9, formed of a glass slit and arranged adjacent to one side of document placement table 2, is controlled by adjusting the timing based on the detection of this signal.

In this case, first scan unit 4 of scanner portion 3 is controlled so that it is positioned ready to go under document reading station 9.

As to the scan of original G that is fed onto this document reading station 9, one side of the original, namely, the first image-scan side G1 is scanned by first scan unit 4 of scanner portion 3 while the original is being moved. Other operations such as image reading by photoelectric transducer 7, the image processing of the image information, the image forming process including printing etc., are performed in the same manner as above.

The original G that has been scanned through document reading station 9 is conveyed by a conveyance roller 47 through document discharge path 48 toward the document discharge roller 49 side. When document reading is performed for one side only, the document is discharged onto a document output tray 51 by the switching control of a document switching gate 50.

On the other hand, when document reading is performed for both sides, by the switching control with document switching gate 50 original G is once discharged onto a middle tray 52 disposed between document tray 41 and document output tray 51, then is switched back into a document reversing path 53 by driving document discharge roller 49 in reverse. This original G is once again fed into document conveyance path 44 so that the original image on the underside of original G facing the image reader is scanned while the original image on the underside of original G is printed out on the first printing side of recording paper P1 in the same manner as in the above-described one-side printing operation.

When this printing operation for the first printing side P1 of recording paper P has been finished, recording paper P is reversed by the above-described sheet reversing device, then fed again into image forming portion 10 so that the original image on the front side of original G that has been previously stored in the memory is printed on the second printing side P2.

As shown in FIG. 1, control switches 76 for allowing the user to set up the image forming conditions such as sheet type of recording paper P (sheet thickness etc., in addition to sheet size), print number, magnification, density etc., are arranged on the front portion on the upper side of the image forming apparatus.

Referring next to FIG. 3, the control system of the image forming apparatus according to the embodiment will be described.

As shown in FIG. 3, the image forming apparatus according to the embodiment performs processes such as image reading, image processing, image forming and conveyance of recording paper P, etc., by a central processing unit (CPU) 54 which performs control in accordance with the program stored beforehand in a ROM (read only memory) 55, using temporal storage such as a RAM (random access memory) 56 etc. It is also possible to use other storage such as a HDD (hard disk drive) etc., instead of ROM and RAM.

In the image forming apparatus, the image information of an original(original image data) captured by scanner portion (original reading portion) 3, or original image information transmitted from other terminal devices connected via an unillustrated communication network, is adapted to be input to an image processing portion 57 by way of a communication processor 58.

Image processor 57 shapes the original image information stored in the storage such as RAM 56 or the like into a printing image that is suitable for printing (image forming onto recording paper), in accordance with the aforementioned program.

The printing image information is input to image forming portion 10.

Image forming portion 10, paper conveying portion (performing various detentions and controls of recording paper P in paper feed path 25, main conveyance path 16, sub conveyance path 28 (these are also called paper guides)) 59, fixing unit 30 and paper discharge processor (performing various detentions and controls of recording paper P in paper discharge path 17) 60 are linked with respective drive controllers.

Paper conveying portion 59 conveys recording paper P so through a printing stage (printing process of image information in image forming portion 10) and a fixing stage (at fixing unit 30) for the recording paper P having been processed with printing and then discharges it to paper discharge portion (paper output cassette 22). Here, paper conveying portion 59 receives detection signals from the aforementioned pre-registration detection switch 21C, fixing detection switch 21A and paper discharge detecting switch 21B.

The image forming apparatus has an operational condition setter 77. This operational condition setter 77 sets up operational conditions for image forming and conditions of conveyance etc., in the image forming apparatus, in accordance with the image forming request and the image forming conditions such as the type of recording media etc., designated by the user through control switches 76.

Further, in the image forming apparatus, based on the set operating conditions, drive controller 62 is adapted to control drive actuators for the aforementioned reading portion (scanner portion 3), paper conveying portion 59, image forming portion 10, fixing unit 30, paper discharge processor 60 etc., namely, an original reading driver 64, a recording paper conveyance driver 66, a printing process driver 68, a fixing driver 70 and a paper discharge driver 72 so that they can operate in synchronization with instructions from CPU 54 in accordance with the program stored in ROM 55.

Original reading driver 64 is a drive actuator for the first scan unit 4 and the second scan unit 5 of scanner portion 3.

Recording paper conveyance driver 66 means paper conveying portion 59, specifically, drive motors for paper pickup roller 24 and registration roller 26 along the aforementioned paper feed path 25. Printing process driver 68 is a drive motor for photoreceptor drum 11. Fixing driver 70 is of drive motors for heat roller 31 and pressing roller 32 in fixing unit 30. Paper discharge driver 72 is of drive motors for paper discharge drive roller 18, paper discharge roller 19 etc. All these drivers may be driven by common or different motors with appropriate power transmission mechanisms.

Further, the image forming apparatus may be used with optional configurations 74 including post-processors (stapler, puncher, multi-bin paper output trays, shifter, etc.), automatic document reader (automatic document processor 40 etc.), large-volume paper feed cassettes and the like. These optional configurations 74 incorporate individual controllers separately from the controller of the image forming apparatus so as to operate in synchronization with the main apparatus by performing timing adjustment via the aforementioned communication processor 58.

Here, the program for the image forming apparatus in the embodiment is to realize the history storing function of storing the usage history of the number of prints in the image forming apparatus and the processing time control function of changing the time of the pre-processing operation before, or the post-processing operation after, the printing process effected by printing portion based on the stored usage history so as to exclude the influence on the printing process by the unfixed developer.

The above functions are realized in the image forming apparatus by CPU 54, which in accordance with the program stored in ROM 56, stores the signals (usage history, toner concentration, etc.) output mainly from operation condition setter 77 including control switches 76, etc., image forming portion 10 and concentration sensor 13*b*, into RAM 55 and controls image forming portion 10 using the thus stored data.

[History Storage Portion 78]

History storage portion 78 stores the usage history involving the number of prints of the image forming apparatus.

In the embodiment, "the usage history involving the number of prints to be stored in the history storage portion" is defined as the history of how many times in a predetermined duration requests for printing of a single print and requests for printing of multiple prints (equal to 10 sheets or lower, 11 to 50 sheets, 51 to 100 sheets, and equal to 101 sheets or greater) have been made.

It is preferred that "the usage history stored in the history storage portion" is the usage history of the image forming apparatus at least one day ago (at least one day, preferably one week, more preferably one month). In this way, when the usage history from one day ago is stored, the latest usage history can be known; and use of the usage history for one week or one month makes it possible to change the time of the pre-processing operation or post-processing operation taking into account the usage history over time.

"The usage history" stored in history storage portion 78 in the embodiment is defined by separately counting the number of times (the count of print requests) the image forming apparatus has been used for printing operations for a single print and the numbers of times (the count of print requests) the apparatus has been used for printing operations for multiple prints, so as to present the operation conditions of the image forming apparatus.

Specific counting is performed as shown in FIG. 4. That is, suppose that for the number of requests for a single print A and the numbers of requests for multiple prints (B for 10 sheets or lower, C for 11 to 50 sheets, D for 51 to 100 sheets and E for 101 sheets or greater), summing up are made individually (for the numbers of requests for prints), and each count is multiplied by an appropriate weighting coefficient (operational status sum-up coefficients: "5" for a single print, and for multiple prints "4" for 10 sheets or lower, "3" for 11 to 50 sheets, "2" for 51 to 100 sheets and "1" for 101 sheets or greater) and the thus weighted values are summed up, as shown in the following formula (3):

$$Y=\Sigma\{(5\times A)+(4\times B)+(3C)+(2\times D)+(1\times E)\} \quad (3).$$

Thus the operation status of the image forming apparatus can be estimated from the summation of the counts by the above formula (3).

[Processing Time Controller 80]

A processing time controller 80 changes the duration of the pre-processing operation before, or post-processing operation after, a printing process performed by the image forming portion (printing portion) 10 in accordance with the stored usage history so as to exclude the influence on the printing process by the unfixed developer.

In this way, it is possible to eliminate degradation of printing with the developer image and improve the quality of printing by, for example, preventing the volume density of the developer from becoming high and preventing the collected developer from aggregating in cleaning device 15, in accordance with the usage history.

Example of "the influence on the printing process by the unfixed developer" in the embodiment include: increase in the volume density of the unfixed developer due to cessation (cessation of printing operation) of the image forming apparatus; rotation of the photoreceptor drum (there is a risk that the photoreceptor drum would be damaged if the developing roller is rotated alone when the developer hopper is agitated); and rotational load acting on waste toner conveyor screw 15*a* of cleaning device 15.

In the embodiment, processing time controller 80 calculates the printing process operation time of the image forming apparatus based on the usage history stored in history storing portion 78, and extends the pre-processing operation time or post-processing operation time, longer than the usual processing operation time when the calculated printing process operation time is shorter than a predetermined reference time for change.

The phrase "based on the usage history stored in the history storing portion" means that in the embodiment whether the necessity of extension of initializing operation time (should be extended or not) is determined based on Y<(set value) or Y≧(set value) where Y is the summation obtained by the above formula (3).

"The printing process operation time" may be determined by measuring the actual printing process operation time every time printing is operated, but in the embodiment the value obtained by the formula (3) for calculation of the usage history, which calculates the summation of the counts for a single printing and multiple printing, multiplied by the associated coefficients for operation status, is used instead. This simplifies the numerals to be stored and hence reduce the memory capacity of the storage device, and enhances the control processing operation of CPU 54 and reduces the risk of freezing.

As a variational example, when determination is made by measuring and counting "the printing process operation time" itself, the following method can be used.

In the variational example, in comparison between the printing process operation time of the image forming apparatus calculated based on the usage history stored in history storage 78 and the reference time for change, processing time controller 80 sums up the printing process operation time (T1), the pre-processing operation time (T2) and the post-processing operation time (T3) separately and makes comparison based on the following formulae, and determines whether the pre-processing operation time or post-processing operation time should be made longer or shorter than the normal processing operation time:

$$\Sigma(T1)\leqq(\Sigma(T2)+\Sigma(T3)) \quad (1)$$

$$\Sigma(T1)>(\Sigma(T2)+\Sigma(T3)) \quad (2)$$

where when the relation (1) holds, the printing process operation time is determined to be equal to or longer than the predetermined reference time for change; and when the relation (2) holds, the printing process operation time is determined to be shorter than the predetermined reference time for change.

Since this makes comparison using the summation of time, exact control of the processing time can be done.

In the embodiment, processing time controller 80 calculates the printing process operation time of the image forming apparatus based on the usage history stored in history storing portion 78 and performs the pre-processing operation or post-processing operation with the usual processing operation time when the calculated printing process operation time is equal to or greater than the predetermined reference time for change.

In the embodiment, "the predetermined reference time for change" is set up based on the time during which the image forming apparatus is unused (the time in which no printing process is operated). Specifically, when the image forming apparatus has been unused as long as or longer than the passage of time which would affect the detection of magnetic permeability sensor (toner concentration sensor) 13*b* due to the time-dependent change in the volume density of the unfixed developer, the predetermined reference time for change is set in accordance with the time of cessation.

The developer of the embodiment is a one that contains toner having a smaller diameter (the mean particle size is approximately 4 to 8 μm in diameter) than the conventional toner (the mean particle size is approximately 8 to 12 μm in diameter), and the apparent volume density of the developer varies with passage of time immediately after agitation of the developer as shown by solid line in FIG. 5.

When the magnetic permeability increases with the rise of the apparent volume density of the developer, toner concentration sensor 13*b* of a magnetic permeability sensor determines the toner concentration of the developer to be lower than actual concentration. Without any measures taken, the developer is determined to be low in toner concentration, so that toner is added more than needed.

In contrast, in the embodiment, the effective detection range of toner concentration sensor 13*b* is specified by the range indicated by hatching in FIG. 5. In other words, though the volume density varies with the passage of time over which the apparatus has been unused, if the detected value falls within the effective detection range, it is assumed that the toner concentration can be detected correctly, whereas it is determined that the toner concentration cannot be detected correctly if the detected value falls out of the range.

When the detection value falls within the above effective detection range, hence the toner concentration sensor 13*b* can detect the toner concentration correctly, no reference time for change is set up, hence no change such as extension or the like of the pre-processing operation time or post-processing operation time is made. On the other hand, if the detection value falls out of the range so the toner concentration sensor 13*b* cannot detect the toner concentration correctly, the reference time for change is set up so that extension or the like of the pre-processing operation time or post-processing operation time can be made.

Figure 6:
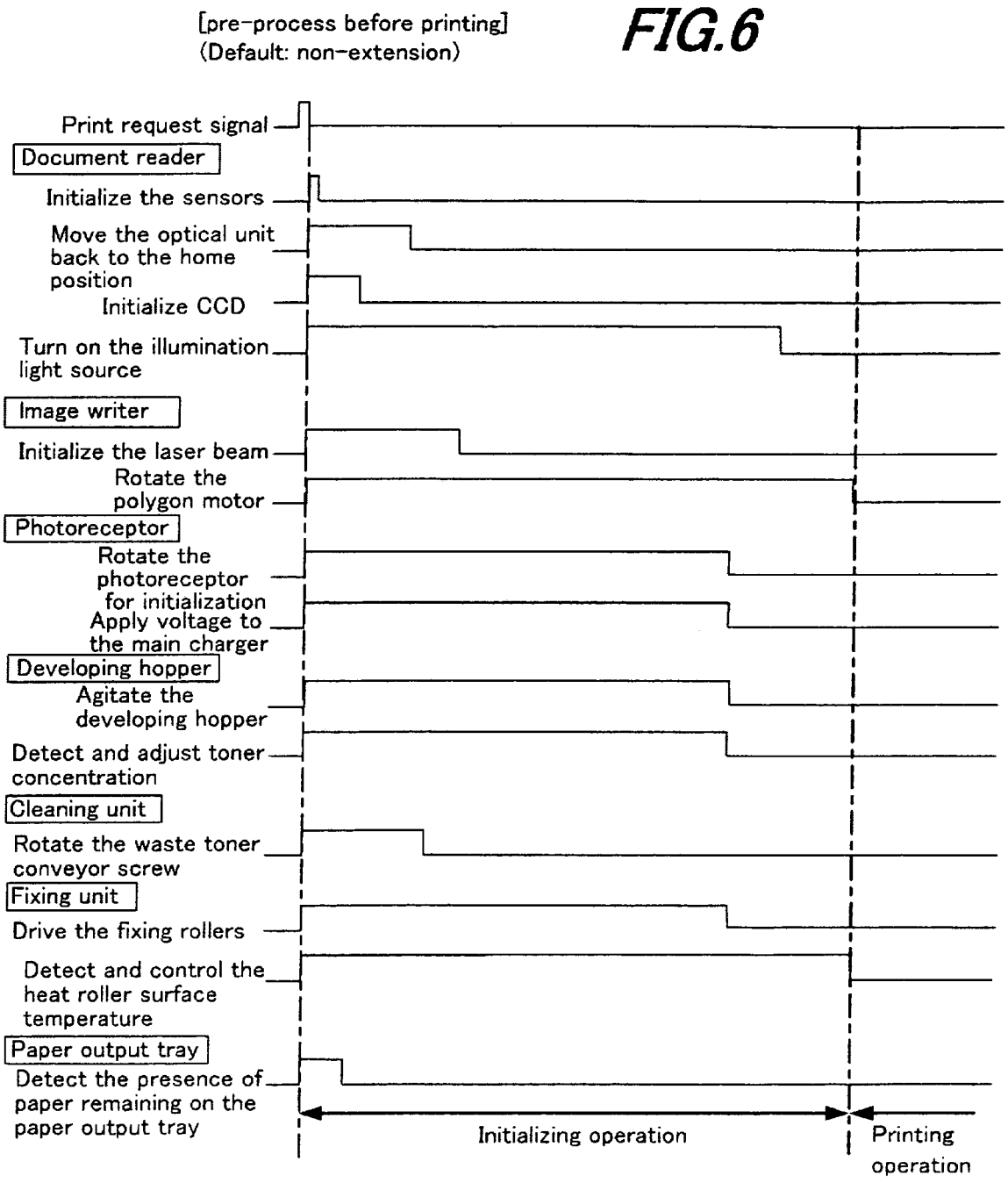
FIG. 6 is an illustrative timing chart of a pre-processing operation when the processing operation time is not extended.
Figure 8:
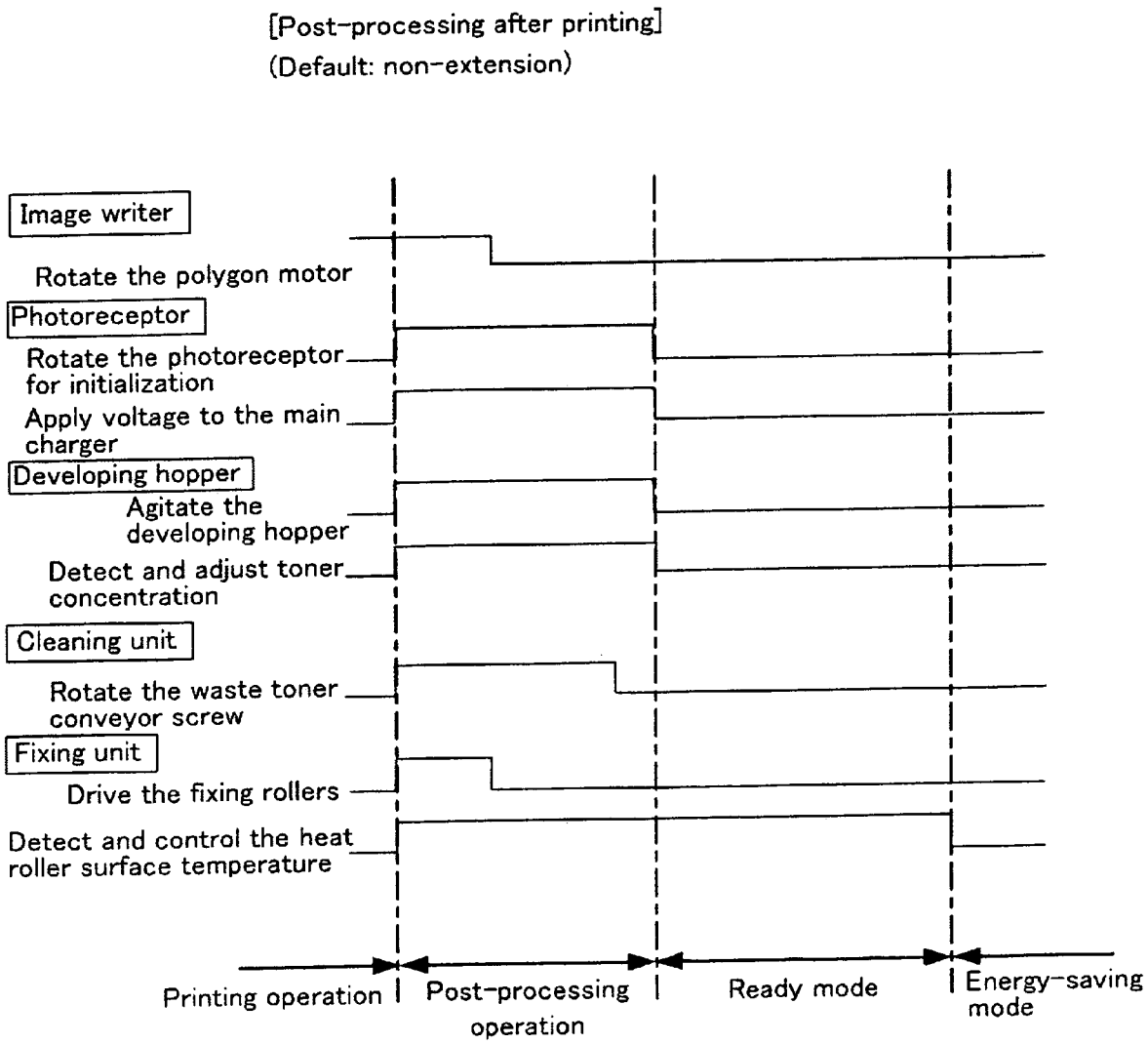
FIG. 8 is an illustrative timing chart of a post-processing operation when the processing operation time is not extended.

FIG. 7 shows a time chart of the pre-processing operation when the processing time is extended in the image forming apparatus of the embodiment while FIG. 6 shows a comparative time chart for the default setup in which the processing time is not extended. Also, FIG. 9 shows a time chart of the post-processing operation when the processing time is extended while FIG. 8 shows a comparative time chart for the default setup in which the processing time is not extended.

In the embodiment, "the pre-processing operation" is performed for an initializing process made up of the following items 1) to 7) as shown in FIG. 7.

1) Each of the sensors in scanner portion 3 (document reader) and photoelectric transducer (CCD) 7 are initialized while the optical unit is moved back to the home position and conduction of current through the illumination light source is performed.
2) In laser scanning unit 8 (image writer), laser beam is initialized and the polygon motor is rotated in a fixed period.
3) Photoreceptor drum 11 is rotated for initialization and voltage is applied to main charger 12.
4) The developer in developer hopper 13*a* of developing unit 13 is agitated and detection and adjustment of the toner concentration is performed.
5) In cleaning device 15 (cleaning unit), waste toner conveyor screw (conveying member) 15*a* is rotated so as to convey the waste toner collected by cleaning device 15 to the collecting box or to developer hopper 13*a*.
6) Heat roller (fixing roller) 31 and pressing roller 32 of fixing unit 30 are driven for initialization and detection and control of the surface temperature of heat roller 31 is performed.
7) Whether there is any remaining paper on paper output cassette 22 (paper output tray) is checked.

Also in the default control shown in FIG. 6 for comparison, the same items 1) to 7) are performed as the pre-processing operation.

In the embodiment, as understood from the comparison between FIGS. 6 and 7, "extension of the time for the pre-processing operation" indicates the extension of the time for agitating the developer in developing hopper 13*a* of developing unit 13. In addition, the rotating time of photoreceptor drum 11 for initialization along with the rotation of developing roller 13*c* during agitation of the developer is also extended.

As described above, in the image forming apparatus of the embodiment, based on the apparatus history (calculation of the time unused), either the extra-time mode for adding the time of pre-agitation of the developing hopper (in the case of FIG. 7, the processing time is extended) or the non-extra-time mode (in the default case shown in FIG. 6, the processing time not extended) can be selected.

In the extra time mode, the initialization step for photoreceptor drum 11 is also added because if the developing roller (developing sleeve) alone is rotated, the photoreceptor drum 11 surface will damage. In the non-extra time mode of not adding the time of pre-agitation, the initializing operation process is performed in a normal (general) method.

The advantage of performing this pre-agitation process is that the developer will become as loose as it is supposed to be. This also improves the accuracy of the toner concentration adjustment. It also contributes to uniformity of the amount of charge on the toner (at the printing operation). It is also possible to stabilize printing quality. Further, there is also an advantage that the load torque on the developer driver can be reduced.

In the embodiment, "the post-processing operation" is performed as the following items 1) to 5) as shown in FIG. 9.

1) In laser scanning unit 8 the rotation ending process of the polygon motor is performed.
2) The rotation of photoreceptor drum 11 is stopped and the voltage application to main charger 12 is stopped.
3) Agitation of the developer in developer hopper 13*a* of developing unit 13 is performed and detection and adjustment of toner concentration is implemented.
4) In cleaning device 15 (cleaning unit), waste toner conveyor screw (conveying member) 15*a* is rotated so as to convey the waste toner collected by cleaning device 15 to the collecting box or to developer hopper 13*a*.

5) Heat roller (fixing roller) 31 and pressing roller 32 of fixing unit 30 are driven for termination, and detection and control of the surface temperature of heat roller 31 is performed.

Also in the default control shown in FIG. 8 for comparison, the same items are performed as the post-processing operation.

In the embodiment, processing time controller 80 makes control such as to continue rotating waste toner conveyor screw (conveying member) 15*a* of cleaning device 15 until the final end of the post-processing operation (after the end of the post-processing operation), to thereby convey all the waste toner collected by cleaning device 15 from the unillustrated storage receptacle to the collecting box or developing hopper 13*a*, so that all the waste toner will have been discharged out from cleaning device 15 at the next printing operation.

There has been a fear that developer conveyor screw 15*a* would lock if the developer (waste toner) collected and stored in the storage receptacle in cleaning device 15 aggregated with passage of time, but the developer (waste toner) laid down in cleaning device 15 can be removed out at the post-processing operation to the collecting box, etc. so as to cleanup the collected developer from the storage receptacle and around the cleaning blade.

This makes it possible to lower the starting load of the drive source when the screw is restarted at the initializing stage of the apparatus, hence prevent locking of the drive source and breakage of the screw. In addition to prevention against locking and breakage of screw 15*a*, it is also possible to positively prevent the developer (waste toner) deposited in cleaning device 15 from damaging the cleaning blade and photoreceptor drum 11 (hence degrading image quality).

Here, in the pre-processing operation, the processing time controller 80 is adapted to extend the time of agitating the unfixed developer in the pre-processing operation until at least the output value from toner concentration sensor 13*b* falls within the predetermined range. That is, when the agitation time is extended until the output value from toner concentration sensor 13*b* at least falls within the predetermined range, it is possible to adjust the toner concentration correctly because the detection can be done based on the stabilized output value from toner concentration sensor 13*b*.

While the time of the pre-processing operation is extended by processing time controller 80, supply of the developer to the developer hopper 13*a* is suspended. Then, after the end of the extended time of the pre-processing operation, adjustment of the developer concentration in developer hopper 13*a* is performed.

In this way, the developer is supplied only after the volume density of the developer has been made pertinent without any risk of erroneous detection of toner concentration sensor 13*b*, so that it is possible to achieve toner concentration adjustment with high precision.

In the embodiment "the printing portion" has photoreceptor drum 11 which is an image forming portion 10 for forming an electrostatic latent image for the unfixed developer. Processing time controller 80, based on the stored usage history, extends the initializing rotational period for developer roller 13*c* (also called developing sleeve) at the pre-processing operation and that for photoreceptor drum 11 at the pre-processing operation, longer than the normal pre-processing operation time, in order to remove the influence of the unfixed developer on the printing process.

In the case where developing roller 13*c* rotates in abutment with photoreceptor drum 11 while the agitator 13*e* in developer hopper 13*a* is driven, there is a risk of photoreceptor drum 11 being damaged if only photoreceptor drum 11 is not operated during initialization. This problem can be solved by also extending rotation of photoreceptor drum 11 during the period in which the pre-processing operation is extended. Thus it is possible to positively prevent damage to photoreceptor drum 11.

Image forming portion (printing portion) 10 has a photoreceptor drum (image support) 11 for bearing image information formed with the unfixed developer; and a cleaning device (cleaning unit) 15 that collects the unfixed developer remaining on the image support at the post-processing operation after the printing process. The influence of the unfixed developer on the printing process is brought by the time-dependent aggregation of the collected developer. Processing time controller 80, based on the stored usage history, extends the drive time of cleaning device 15 in the post-processing operation longer than the normal post-processing operation time.

"The normal post-processing operation time" is the default processing operation time of cleaning device 15 shown in FIG. 8.

When cleaning device 15 is driven in the post-processing operation, in the embodiment conveyor screw 15*a* of cleaning device 15 is preferably driven with a higher torque at the initial stage of activation and then driven with a normal torque. In this case, even if some collected developer remains in the collecting receptacle, the collected developer can be positively brought out to the collecting box or developer hopper 13*a*, by driving conveyor screw 15*a* of cleaning device 15 with a high torque.

It should be noted that when the time for the developer's agitation processing operation beyond the pre-processing operation is extended, the time of rotation of photoreceptor drum 11 is extended, then the printing process is started as shown in FIG. 7. The same is done for the default case shown in FIG. 6.

As shown in FIGS. 8 and 9, after the post-processing operation, the operation enters the ready mode in which the temperature of the fixing roller surface is detected and controlled within the predetermined temperature range so that the printing process can be restarted in a short time if a next printing request is made. As a further time has elapsed, the operation enters the energy saving mode in which no temperature control of the fixing roller is performed.

In the case of the present embodiment, as shown in FIG. 9, when the drive time of conveyor screw 15*a* of cleaning device 15 is extended, the other processing operations such as the image writing process in image forming portion 10 may enter the ready mode in advance.

Next, the operation of the above embodiment will be described with reference to the flowchart shown in FIG. 10. In FIG. 10, each "Step" is abbreviated as "S".

First, when a print request is made (Step 2) during the waiting status (waiting mode) (Step 1), the time of cessation of the image forming apparatus from the last printing operation is calculated (Step 3).

Based on the time, i.e., the time during which the apparatus has been unused, it is determined using the relation shown in FIG. 5, whether the volume density of the developer in developing hopper 13*a* has already become high enough for toner concentration sensor 13*b* to make a wrong detection (Step 4).

If the determination result is negative, or if the volume density of the developer is not higher than the predetermined density (Step 4: No), the initializing process is executed with the default initializing process operation time (T1) of the image forming apparatus, as shown in FIG. 6 (Step 5).

Then, the printing process is implemented (Step 6).

On the other hand, if the determination result is positive, or if the volume density of the developer is higher than the predetermined density (Step 4: Yes), toner supply is suspended (Step 7).

Then, the default initializing operation time (see FIG. 6) of the image forming apparatus is extended to implement the extended initializing process (see FIG. 7) (Step 8). In this case, the agitation time of developing hopper 13*a* is extended.

Next, it is determined whether the detection value from toner concentration sensor 13*b* of the developer has stabilized (Step 9).

If the detection value of toner concentration sensor 13*b* has been stabilized (Step 9: Yes), the suspension of toner supply is cancelled (Step 10). If not stabilized, the operation returns to Step 8, and the initializing process is continued.

After Step 10, it is determined whether the initializing process is ended or not (Step 11), and after it is ended, the printing process is started (Step 6).

After the printing process, it is determined whether a next printing operation is present (Step 12), and if there is a next printing operation, the printing process (Step 6) is repeated. If there is no next printing, the post-processing of the image forming apparatus is executed (S13).

In the post-processing, cleaning device 15 is driven. By driving conveyor screw 15*a* long enough, the collected waste toner in cleaning device 15 is conveyed to the unillustrated collecting box or developing hopper 13*a* without fail.

The image forming apparatus of the present technology should not be limited to the above embodiment, but various changes can be of course added without departing from the scope of the present technology.

What is claimed is:

1. An image forming apparatus comprising:

a paper feed portion for storing paper and selectively feeding and conveying the paper, sheet by sheet, from a stack of paper stored therein;

a printing portion for performing a printing process for transferring image information of an unfixed developer to paper;

a fixing portion for fusing and fixing the image information formed of the unfixed developer to the paper;

a paper discharge portion for discharging the paper with the image information fused and fixed thereon to the outside of the apparatus;

a history storage portion configured to store a usage history involving a number of prints of the image forming apparatus; and, a processing time controller configured to change a time of the pre-processing operation before or a time of a post-processing operation after a printing process of the printing portion, based on the stored usage history so as to exclude the influence of the unfixed developer on the printing process, wherein the usage history stored in the history storage portion is defined by separately counting the number of times the image forming apparatus has been used for printing operations for a single print and the number of times the apparatus has been used for printing operations for multiple prints, wherein, in comparison between the printing process operation time of the image forming apparatus calculated based on the usage history stored in the history storage and a reference time for change, the processing time controller sums up the printing process operation time (T1), the pre-processing operation time (T2) and the post-processing operation time (T3) of image forming apparatus separately and makes comparison based on the following formulae, and determines whether the pre-processing operation time or post-processing operation time should be made longer or shorter than the normal processing operation time:

$$\Sigma(T1) \leqq (\Sigma(T2)+\Sigma(T3)) \quad (1)$$

$$\Sigma(T1) > (\Sigma(T2)+\Sigma(T3)) \quad (2)$$

where when the relation (1) holds, the printing process operation time is determined to be equal to or longer than the predetermined reference time for change; and when the relation (2) holds, the printing process operation time is determined to be shorter than the predetermined reference time for change.

2. The image forming apparatus according to claim 1, wherein the usage history stored in the history storage portion is the usage history of the image forming apparatus at least one day ago.

3. The image forming apparatus according to claim 1, wherein the processing time controller calculates the printing process operation time of the image forming apparatus based on the usage history stored in the history storing portion, and extends the pre-processing operation time or post-processing operation time, longer than the usual processing operation time when the calculated printing process operation time is shorter than a predetermined reference time for change.

4. The image forming apparatus according to claim 1, wherein the processing time controller calculates the printing process operation time of the image forming apparatus based on the usage history stored in the history storing portion and performs the pre-processing operation or post-processing operation with the usual processing operation time when the calculated printing process operation time is equal to or greater than a predetermined reference time for change.

5. The image forming apparatus according to claim 3, wherein the predetermined reference time for change is set up based on the time over which no printing process is operated in the image forming apparatus.

6. The image forming apparatus according to claim 4, wherein the predetermined reference time for change is set up based on the time over which no printing process is operated in the image forming apparatus.

7. The image forming apparatus according to claim 1, further comprising a toner concentration sensor for detecting the toner concentration of the developer made up of a toner and a carrier and held in the developer hopper, wherein, when the image forming apparatus has been unused as long as or longer than the passage of time which would affect the detection of the toner concentration sensor due to the time-dependent change in the volume density of the unfixed developer, the predetermined reference time for change is set in accordance with the time of cessation.

8. The image forming apparatus according to claim 7, wherein the processing time controller, based on the stored usage history, extends the time of agitating the unfixed developer in the pre-processing operation until the volume density of the unfixed developer reaches a value at which the toner concentration sensor will not produce a wrong detection.

9. The image forming apparatus according to claim 7, further comprising a toner concentration sensor for detecting the toner concentration of the developer made up of a toner and a carrier and held in the developer hopper, wherein the processing time controller extends the time of agitating the unfixed developer in the pre-processing operation until at least the output value from the toner concentration sensor falls within the predetermined range.

10. The image forming apparatus according to claim 7, wherein, while the time of the pre-processing operation is extended by the processing time controller, supply of the developer to the developer hopper is suspended.

11. The image forming apparatus according to claim 10, wherein, after the end of the extended time of the pre-processing operation, adjustment of the developer concentration in the developer hopper is performed.

12. The image forming apparatus according to claim 7, wherein the printing portion has a photoreceptor drum for forming an electrostatic latent image for the unfixed developer, and the processing time controller, based on the stored usage history, extends the initializing rotational period for a developer roller at the pre-processing operation and that for the photoreceptor drum at the pre-processing operation, longer than the normal pre-processing operation time, in order to remove the influence of the unfixed developer on the printing process.

13. The image forming apparatus according to claim 1, wherein the printing portion includes a photoreceptor drum for bearing image information formed with the unfixed developer and a cleaning unit that collects the unfixed developer remaining on the image support at the post-processing operation after the printing process, the influence of the unfixed developer on the printing process is time-dependent aggregation of the collected developer, and the processing time controller, based on the stored usage history, extends the drive time of the cleaning unit in the post-processing operation, longer than the normal post-processing operation time.

14. The image forming apparatus according to claim 13, wherein when the cleaning unit is driven in the post-processing operation, the cleaning unit is preferably driven with a higher torque at the initial stage of activation and then driven with a normal torque.

* * * * *